US008826484B2

(12) United States Patent
Schultheis

(10) Patent No.: US 8,826,484 B2
(45) Date of Patent: Sep. 9, 2014

(54) UPWARD EXTENDING BRUSH FOR FLOOR CLEANER

(76) Inventor: Thomas K. Schultheis, Santa Barbara, CA (US)

( * ) Notice: Subject to any disclaimer, the term of this patent is extended or adjusted under 35 U.S.C. 154(b) by 30 days.

(21) Appl. No.: 13/567,441

(22) Filed: Aug. 6, 2012

(65) Prior Publication Data

US 2014/0033463 A1 Feb. 6, 2014

(51) Int. Cl.
*A46B 15/00* (2006.01)

(52) U.S. Cl.
USPC ..... 15/246; 15/367

(58) Field of Classification Search
USPC ..... 15/161, 246, 364, 367
See application file for complete search history.

(56) References Cited

U.S. PATENT DOCUMENTS

| | | | | |
|---|---|---|---|---|
| 56,252 | A * | 7/1866 | Newbury | 15/161 |
| 114,847 | A * | 5/1871 | Osborne | 15/161 |
| 2,728,933 | A * | 1/1956 | Pieper et al. | 15/246 |
| 2,966,694 | A | 1/1961 | Brown, Jr. | |
| 2,975,456 | A | 3/1961 | Davidson | |
| 3,380,103 | A | 4/1968 | Ritzau | |
| 3,382,525 | A | 5/1968 | Belicka | |
| 4,122,577 | A * | 10/1978 | Catania | 15/160 |
| 4,564,972 | A | 1/1986 | Varin | |
| 4,688,294 | A | 8/1987 | Simonsson | |
| D312,904 | S | 12/1990 | Worwag | |
| 5,060,342 | A | 10/1991 | Brazier | |
| 5,839,158 | A | 11/1998 | Schupp et al. | |
| 7,293,325 | B2 * | 11/2007 | Moshenrose et al. | 15/363 |
| 7,636,979 | B1 | 12/2009 | Morad | |
| 2004/0016072 | A1 | 1/2004 | Libman et al. | |
| 2011/0000039 | A1 | 1/2011 | Perez | |

FOREIGN PATENT DOCUMENTS

| | | | |
|---|---|---|---|
| DE | 10241492 | A1 | 3/2004 |

* cited by examiner

*Primary Examiner* — Randall Chin
(74) *Attorney, Agent, or Firm* — Felix L. Fischer

(57) ABSTRACT

An upstanding brush assembly for attachment to a cleaning apparatus includes a brush element and a brush clip receiving and constraining the brush element. A mounting bracket attached to a surface of the cleaning apparatus is engaged by the brush clip for positioning the brush element in a substantially vertical upstanding position.

13 Claims, 16 Drawing Sheets

UPWARD EXTENDING BRUSH FOR FLOOR CLEANER

BACKGROUND

1. Field

This invention relates generally to the field of cleaning attachments for floor cleaning devices and more particularly to a vertically upstanding brush system for attachment to vacuum cleaners or similar floor cleaning devices to allow simultaneous dusting of indented overhangs on furniture or cabinet toe-kicks and due to its fanlike shape, uneven areas horizontally as well.

2. Description of the Related Art

Vacuum cleaners and other floor cleaning appliances including push brooms and similar devices are adapted for cleaning the floor surface which may include carpeting, wood or composite substrates. In most homes and businesses, furniture such as sofas, couches and lounging chairs as well as straight back chairs or other wooden furniture having support cross pieces or rungs are present on the floor and toe-kicks or other indentations at the floor level are present in cabinetry or built-in wall units of various forms. Cob webs, dust and other detritus, commonly referred to as "dust bunnies", may be adhered to the undersurface of such furniture and fixtures. Floor cleaning appliances typically do not provide a means for cleaning the underside of furniture or fixtures to properly extricate the dust bunnies. Such cleaning usually requires additional cleaning elements or hand cleaning effort.

It is therefore desirable to provide a device which cleans the underside of furniture and fixtures concurrently with normal floor cleaning without requiring separate cleaning effort. It is also desirable that such a device be adaptable for retrofit or original equipment manufacturing of existing floor cleaning appliances.

SUMMARY

The embodiments disclosed herein overcome the shortcomings of the prior art by providing an upstanding brush assembly for attachment to a cleaning apparatus including a brush element and a brush clip receiving and constraining the brush element. A mounting bracket attached to a surface of the cleaning apparatus is engaged by the brush clip for positioning the brush element in a substantially vertical upstanding position.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1A:
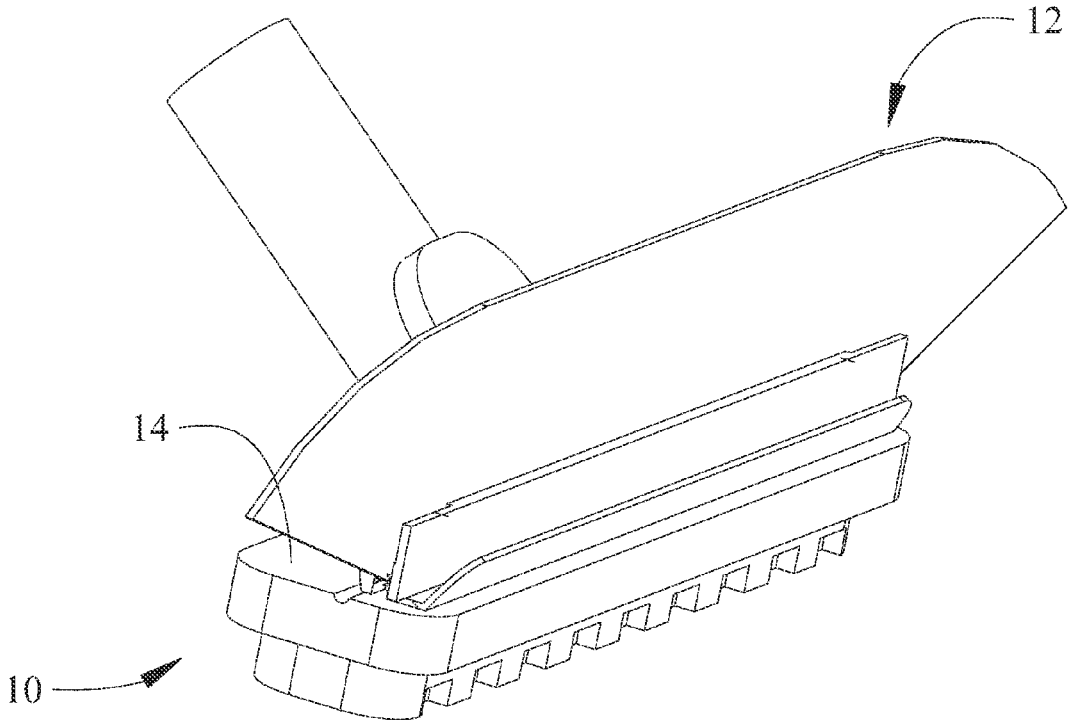
FIG. 1A is an isometric view of an embodiment of the invention as installed on a vacuum cleaner wand attachment for a canister type vacuum.
Figure 1B:
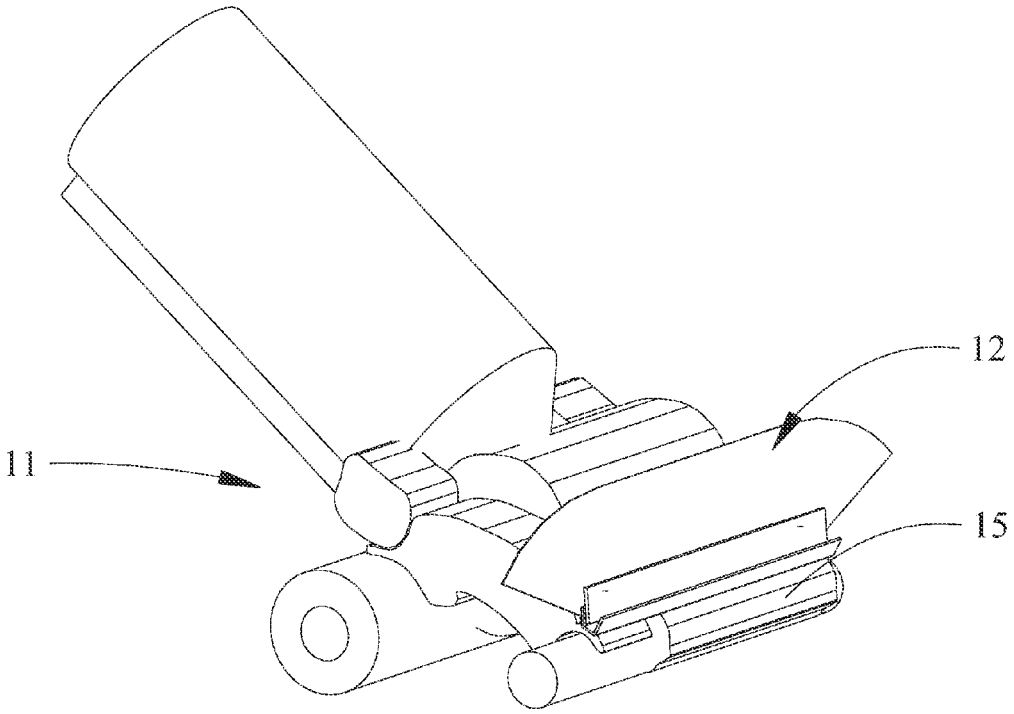
FIG. 1B is an isometric view of an embodiment of the invention as installed on an upright vacuum cleaner.

Embodiments shown in the drawings and described herein provide an upstanding brush assembly extending from the top of a vacuum cleaner attachment or similar appliance which provides for simultaneous cleaning of the underside of furniture or fixtures when the floor under such furniture or fixtures is cleaned by the appliance. Bending the brush assembly at the lateral edges into a fan shape allows simultaneous cleaning of vertical surfaces such as toe-kicks. Referring to the drawings, FIG. 1A shows a canister type vacuum cleaner wand attachment 10 which is employed for cleaning carpet or floors. An upstanding brush assembly 12 extends from an upper surface 14 of the attachment 10. A brush element 16 extends between 4 and 6 inches above the attachment for the embodiment shown, but may be any desired height. As shown in FIG. 1B, the upstanding brush assembly may be employed on an upright vacuum cleaner 11 as well, attaching to an upper surface 15. The embodiments disclosed may additionally be employed on robotic vacuum cleaners or applied to unpowered broom or sweeping apparatuses for concurrent upward and downward cleaning effectiveness.

Figure 2A:
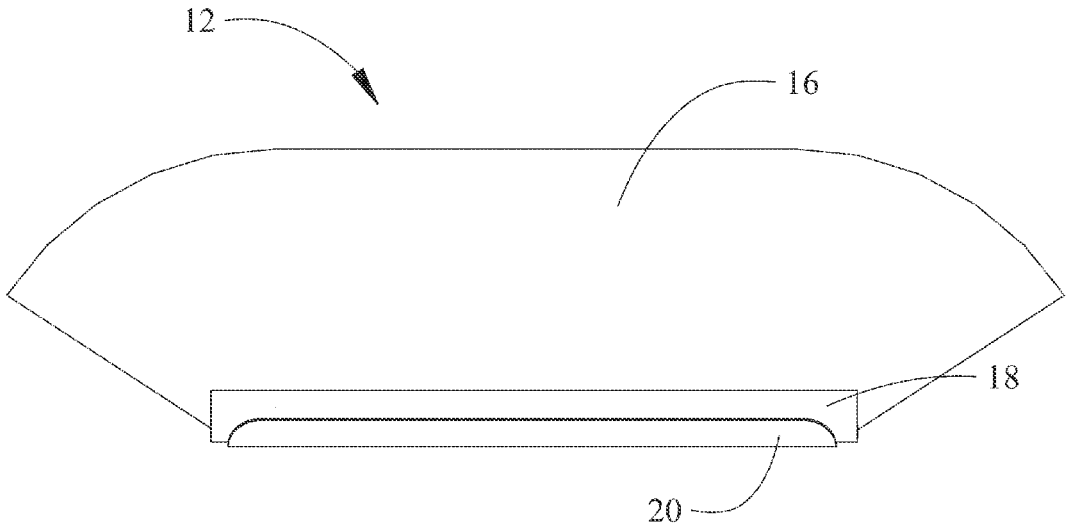
FIG. 2A is a front view of the embodiment of FIG. 1 as assembled for installation on a floor cleaning appliance.
Figure 2B:
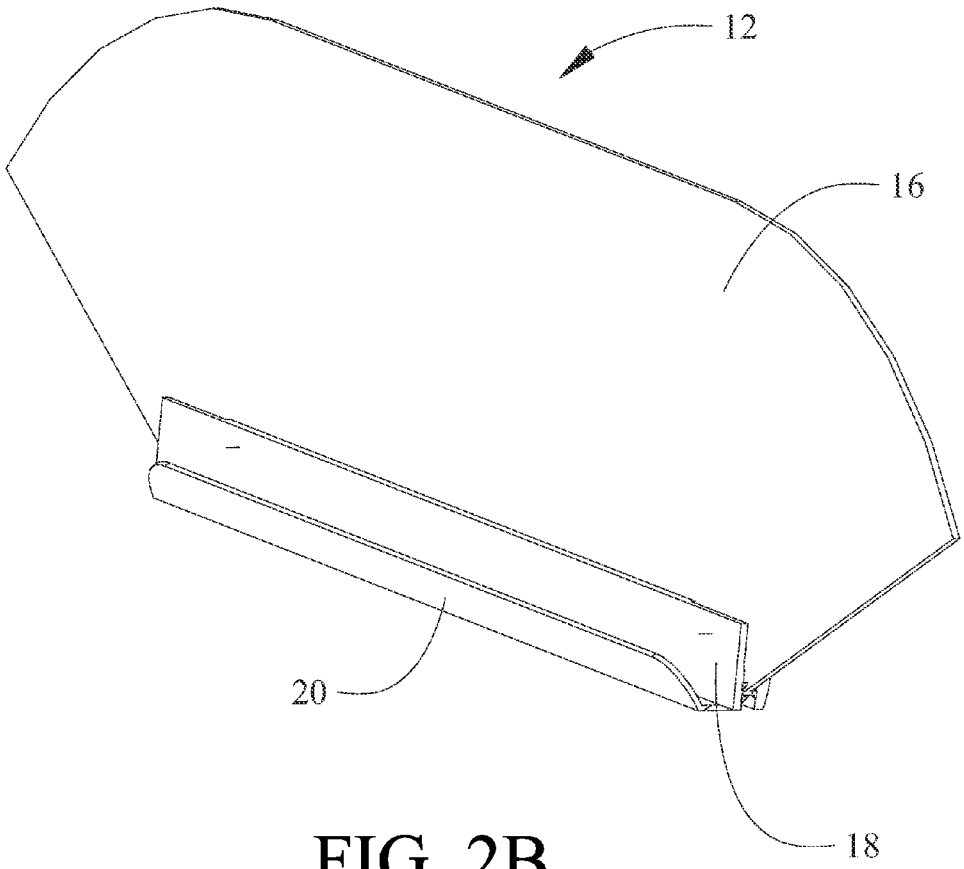
FIG. 2B is an isometric view of the embodiment shown in FIG. 2A.

Details of the upstanding brush assembly 12 are shown in FIGS. 2A and 2B. The brush element 16 (detail of individual brush bristles is not shown for greater clarity in the overall brush shape) is held by a brush clip 18 which will be described in greater detail subsequently. For flexibility in installing and removing the brush assembly 12 from the vacuum cleaner or attachment, a mounting bracket 20 is employed. The mounting bracket may be attached to the upper surface 14, 15 adhesively, with mechanical fasteners or, in alternative embodiments molded directly into the upper or front surface. The individual components are clearly seen in the exploded view of the upstanding brush assembly shown in FIG. 3.

Once attached to the head of the brush or vacuum, the embodiments shown will easily clean and disturb spider and cobwebs and other caught debris, such as pet hair or dust bunnies that collects under furniture, toe-kicks, chair and table rungs and around potted plants, or other items standing on the floor. When used with a canister machine, the brush can easily be raised using the wand, to clean any surface from the ceiling to the baseboards. The embodiments will catch the webs for removal and encourage caught debris to fall to the floor where it will suctioned up during normal cleaning. Any debris caught in the bristles can also be sucked up directly by detaching the attachment and using the end of the suction wand. The bristles of the brush element 16 are resiliently bendable up to 90 degrees, thus taking up little additional vertical space on the equipment and flexing for inserting under low overhangs.

Figure 3:
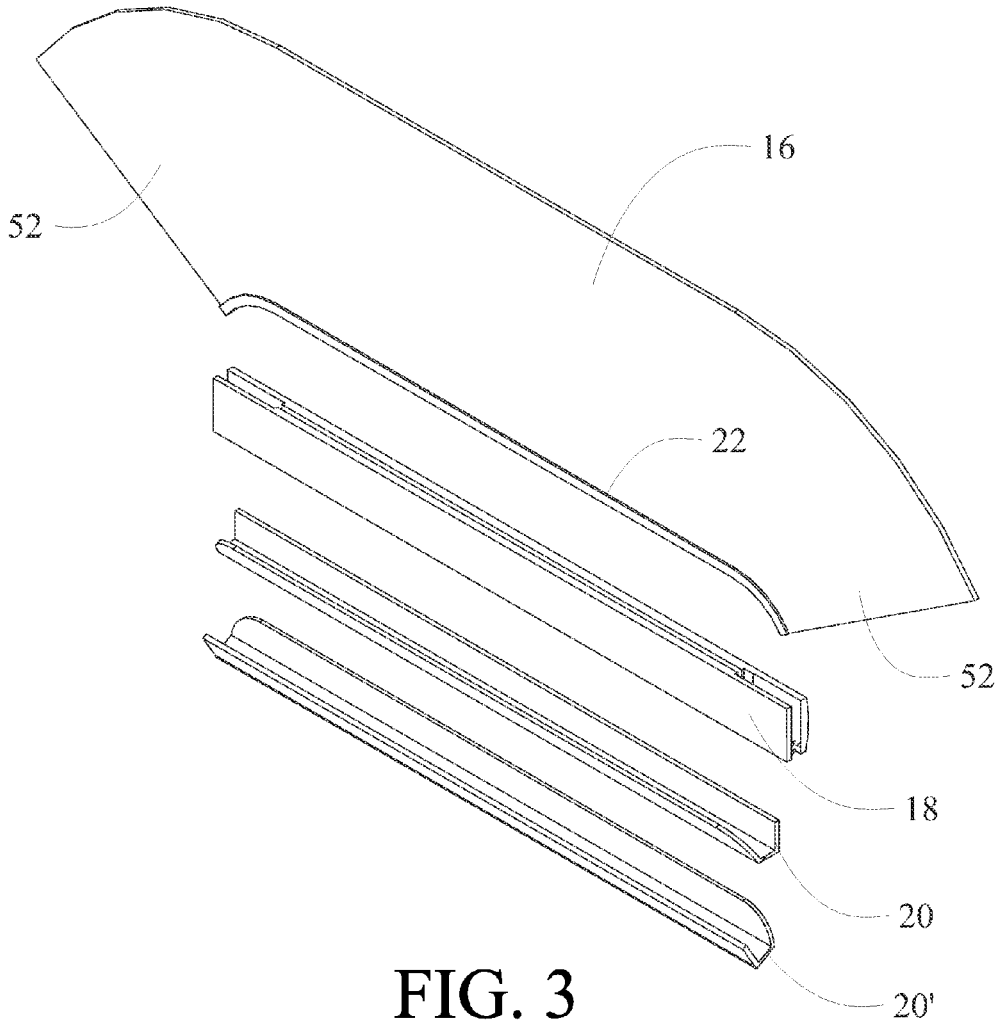
FIG. 3 is an exploded isometric view showing the individual components of the embodiment.
Figure 4A:
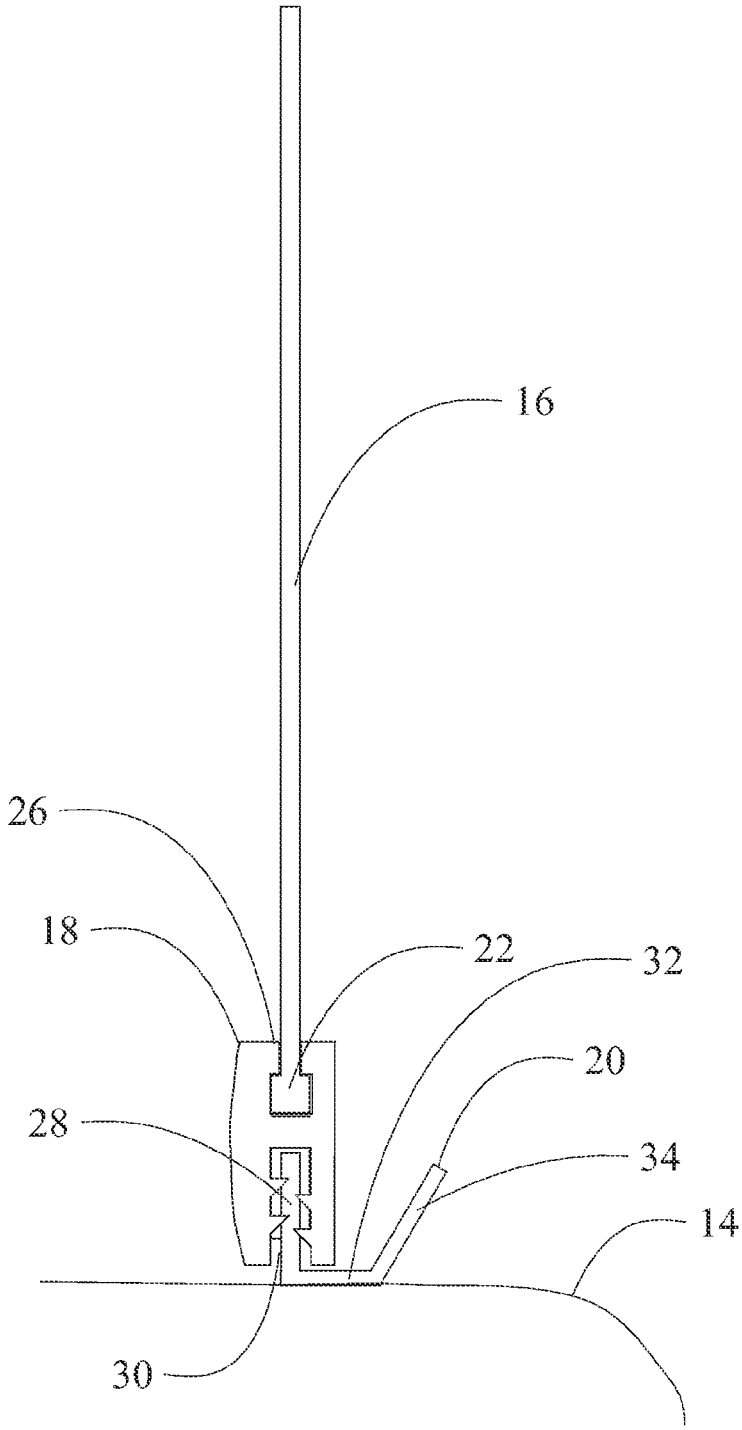
FIG. 4A is a side section view of the embodiment showing the inter engagement of the components.
Figure 4B:
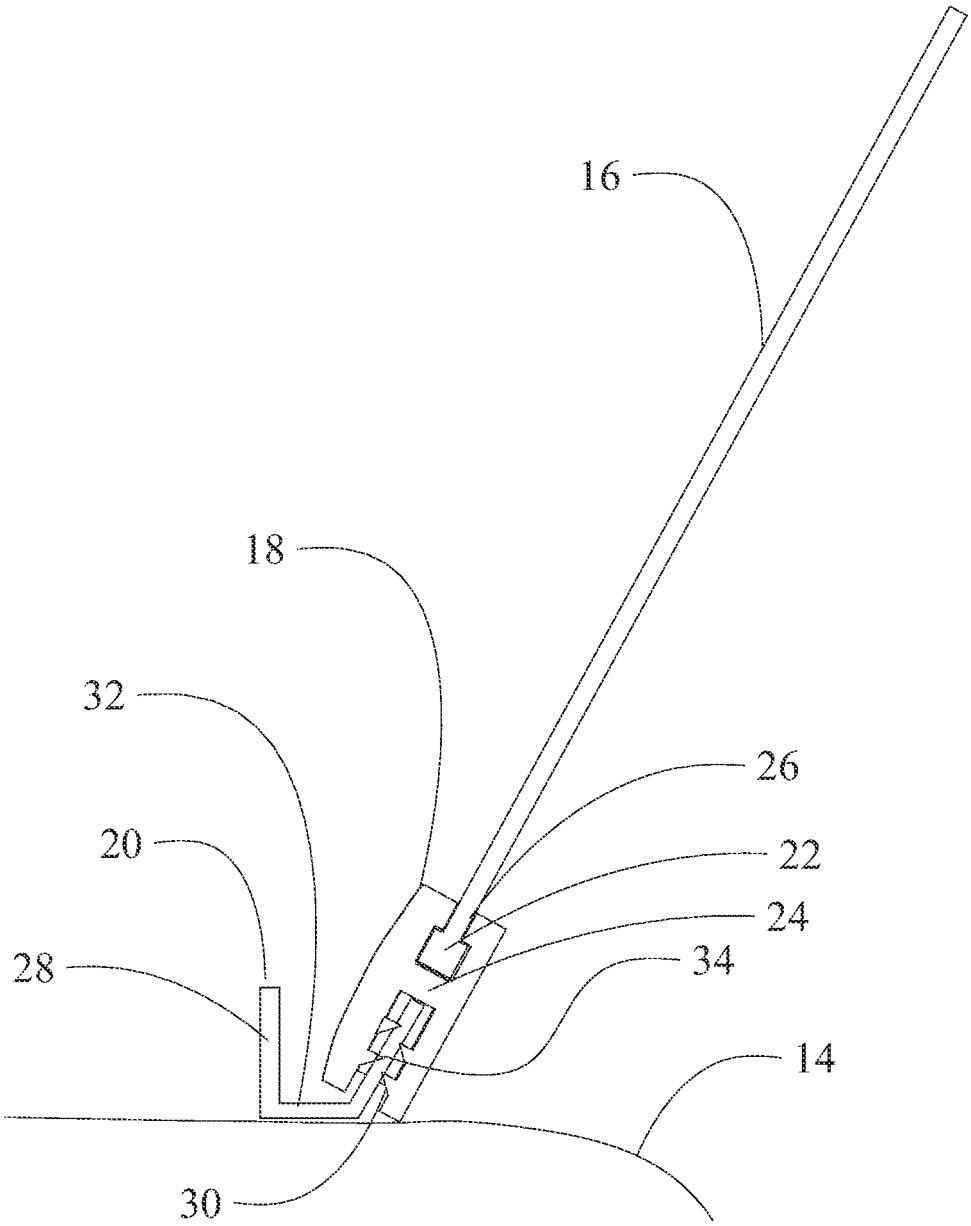
FIG. 4B is a side section view of the embodiment with the brush element mounted on an angle flange.

Referring to FIG. 4A, the brush element 16 incorporates a spine 22 which is received in the brush clip 18 and supported on a web 24. The brush element 16 extends upward through a slot 26. The mounting bracket 20 incorporates an upright flange 28 which is received by the brush clip through a bottom aperture 30. The mounting bracket 20 employs a horizontal engagement flange 32 perpendicular to the clip flange 28 which is mounted to the upper surface 14 of the vacuum attachment or other appliance to provide a vertical extension of the brush element 16. An angle flange 34 is provided as a secondary mounting for the brush clip 18 which provides an angled protrusion of the brush element 16 as an alternative angled cleaning position as shown in FIG. 4B. The mounting bracket may be reversed as shown in FIG. 3 as element 20' which places the engagement flange 32 at an angle for mounting to a sloping surface such as the upright vacuum cleaner shown in FIG. 1B with angle flange 34 providing the vertical positioning of the brush element and upright flange 28 providing mounting for the alternative angled cleaning position. The three elements of the mounting bracket, the clip flange 28, engagement flange 32 or angle flange 34 may provide the attachment surface to the cleaning device depending on whether the attachment surface is horizontal, vertical or sloped. As previously described, the attachment may be by mechanical fastener or adhesive. In various embodiments, the mounting bracket may be extruded or molded rigid plastic, aluminum or steel depending on strength and durability requirements for the desired application.

Figure 5A:
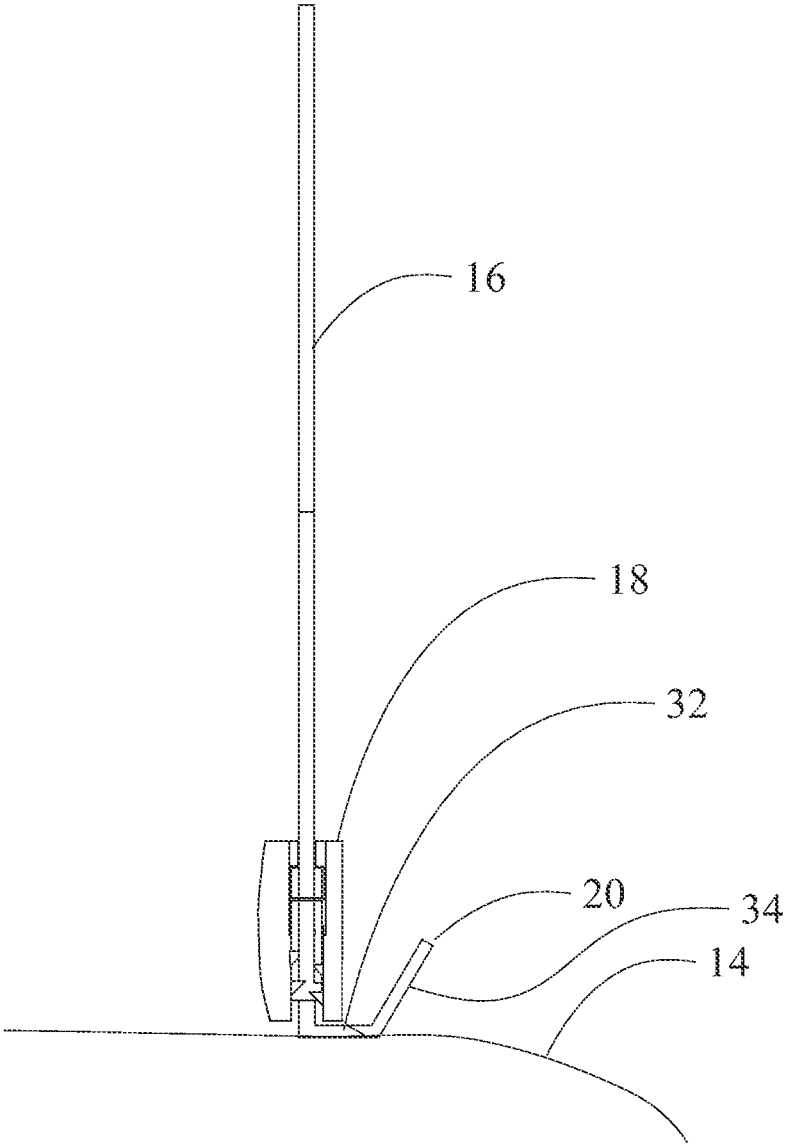
FIG. 5A is a side view of the embodiment with the in a first orientation with a vertical extension attachment of the brush element.
Figure 5B:
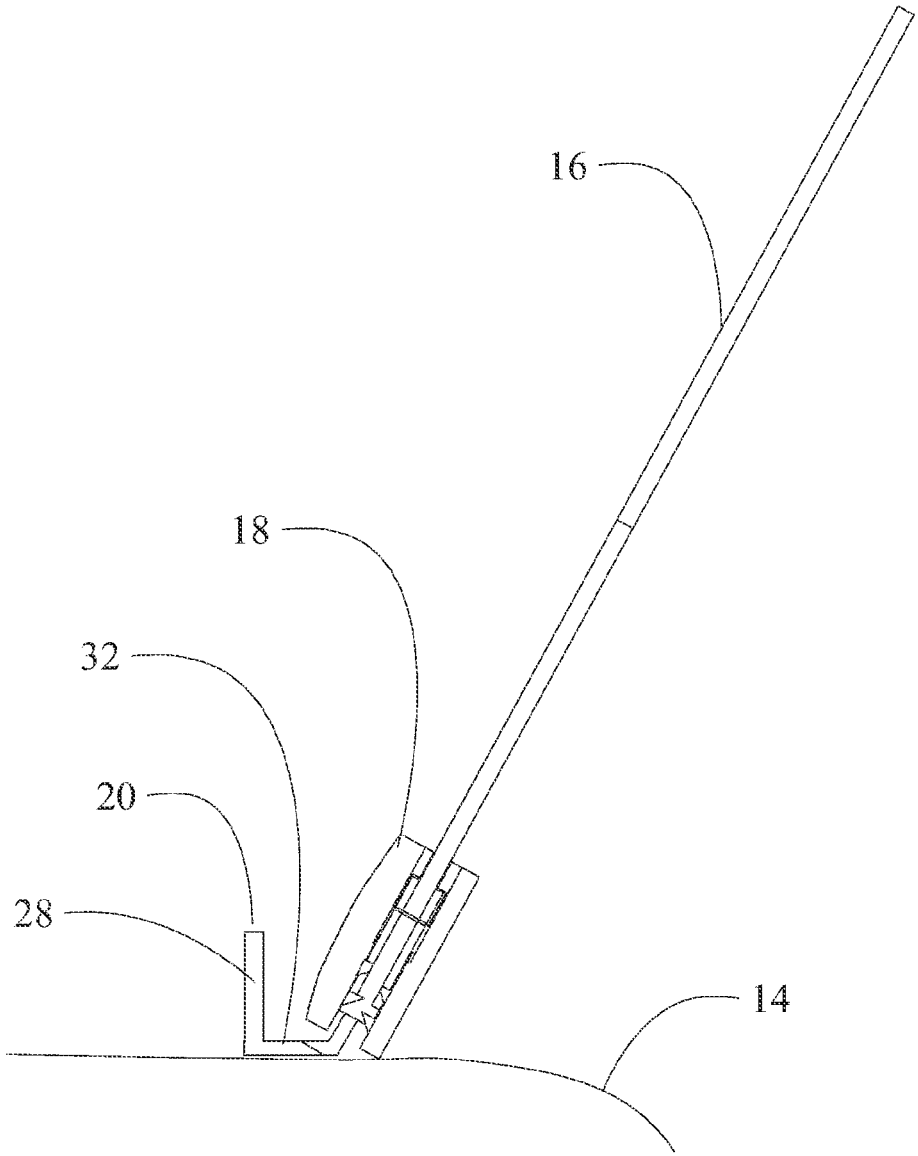
FIG. 5B is a side view of the embodiment in an angled protrusion attachment of the brush element.
Figure 5C:
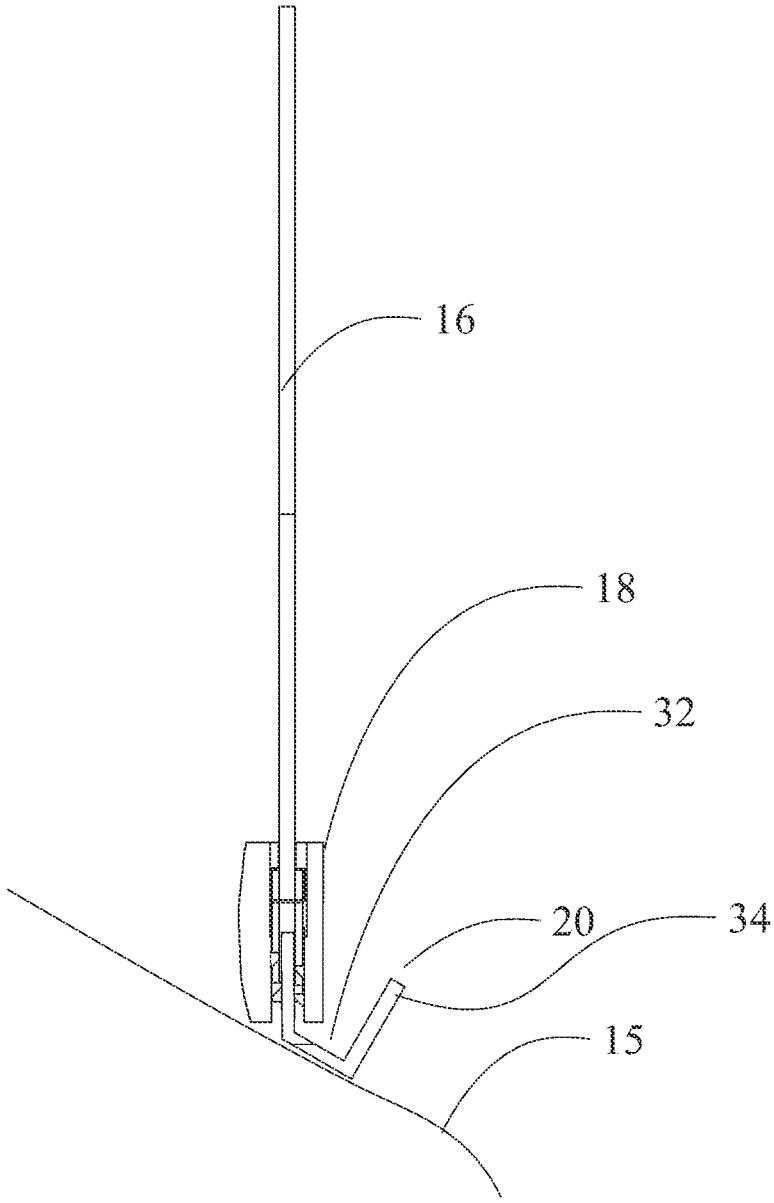
FIG. 5C is a side view with the mounting bracket reversed to accommodate a sloped top surface of the appliance allowing a vertical extension attachment of the brush element on the angle flange.
Figure 5D:
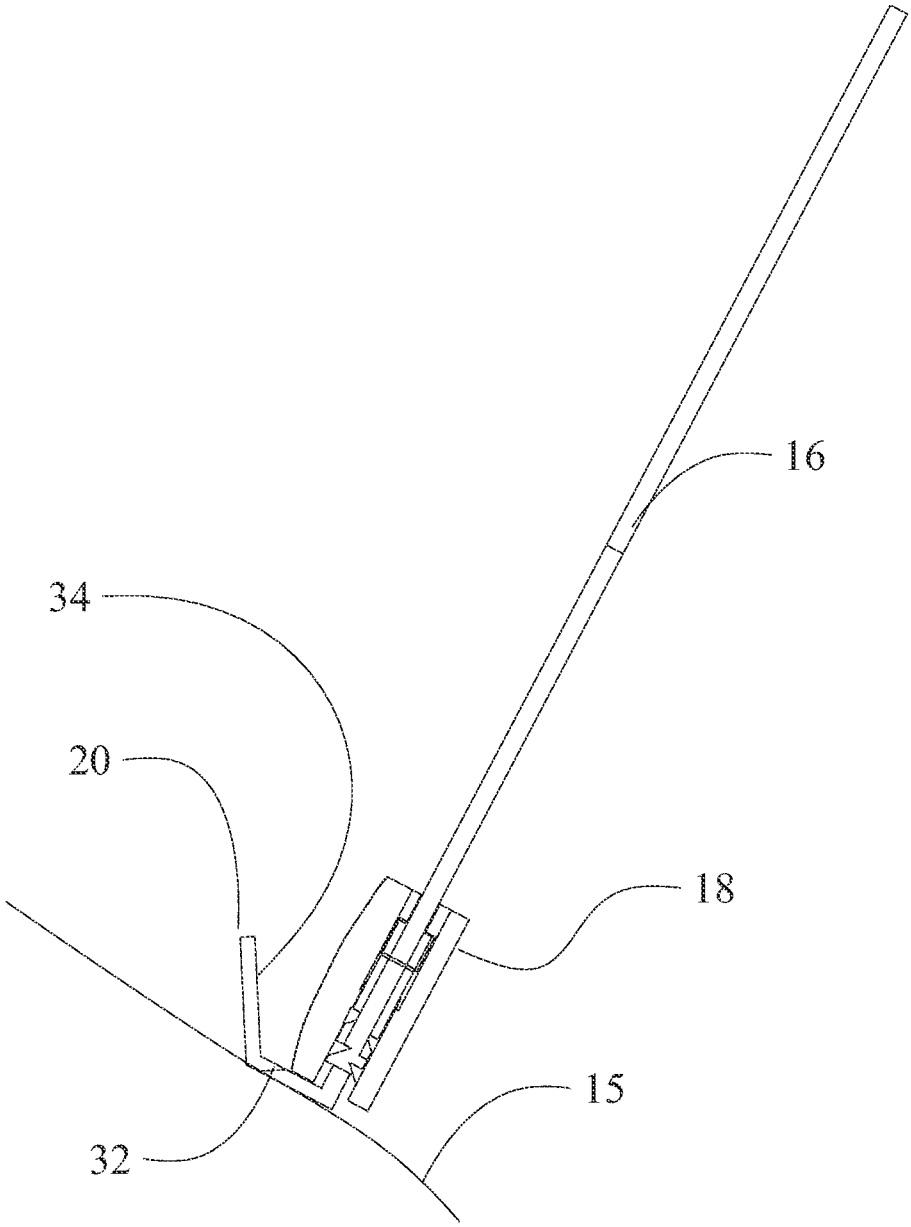
FIG. 5D is a side view as in FIG. 5C with the brush element attached in an angled protrusion.

As seen in FIGS. 5A and 5B, attachment of the mounting bracket 20 to a horizontal surface 14 allows vertical extension of the brush element 16 when mounted on the upright flange 28 (FIG. 5A) and angled protrusion of the brush element 16 when mounted on the angle flange 34. Similarly, with the mounting bracket reversed as shown in FIGS. 5C and 5D, mounting of the bracket 20 to a sloped surface 15 allows vertical extension of the brush element 16 when mounted on the angled flange 34 (FIG. 5C) and angled protrusion of the brush element 16 when mounted on the upright flange 28 (FIG. 5D).

Figure 6:
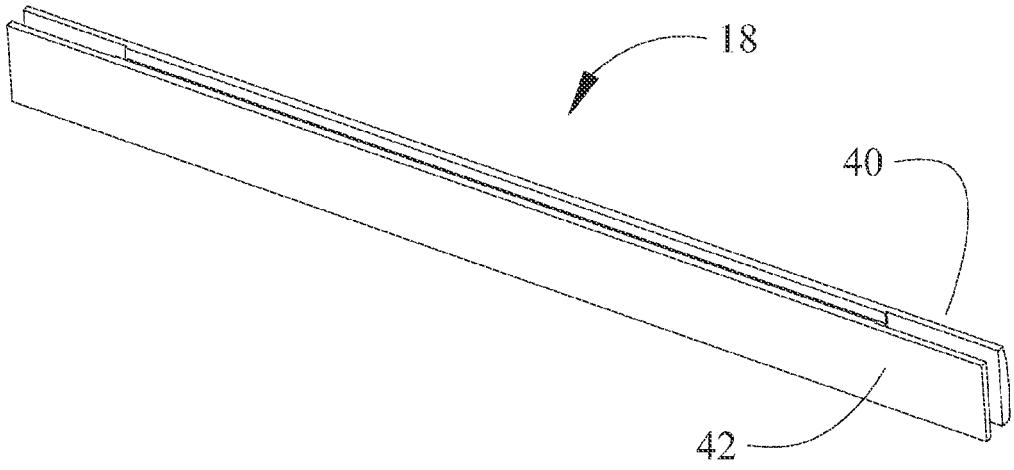
FIG. 6 is a detailed isometric view of the brush clip.
Figure 7:
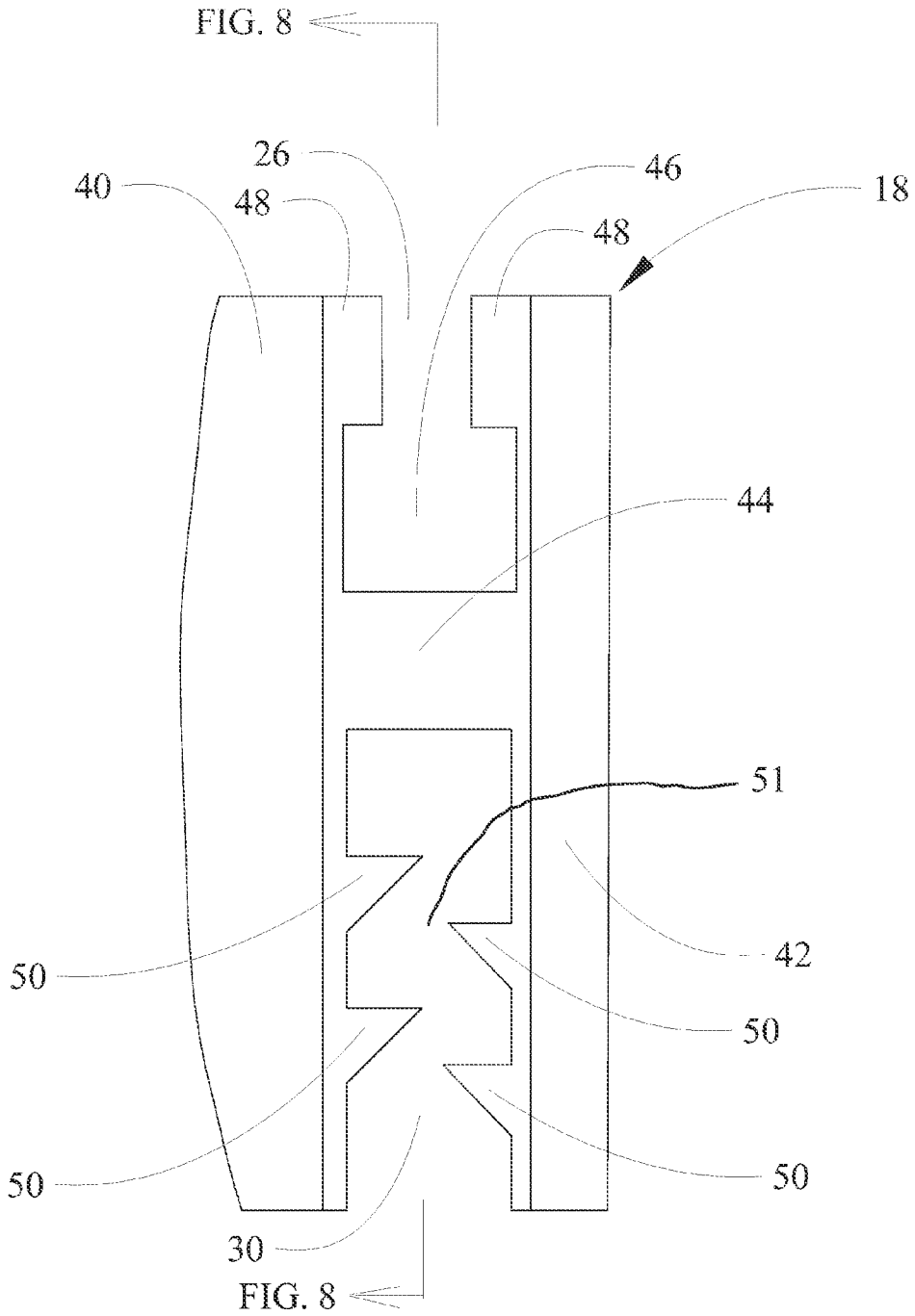
FIG. 7 is a side section view of the brush clip.

Securing of the brush element 16 is accomplished with the brush clip 18 shown in FIG. 6. For the example embodiment, the brush clip is a molded or extruded plastic element having a front wall 40 and a rear wall 42 joined by a web 44 as best seen in FIG. 7. In alternative embodiments an aluminum extrusion may be employed. An upper channel 46 formed by the front wall, web and rear wall with lips extending from the walls receives the spine 22 of the brush element 16. For an example embodiment, lips 48, front wall 40 and rear wall 42 resiliently deform to allow the spine to be press fit into the upper channel 46.

For the embodiment shown in FIG. 7, a lower channel 51 receives the upright flange 28 or angled flange 34 to mount the brush clip to the bracket 20. Flexible protrusions 50 extend from the front wall 40 and rear wall 42 into the lower channel to engage and secure the selected flange. The protrusions 50 are sufficiently resilient to allow the clip to be mounted to the upright or angled flange and then removed and remounted to the other flange to change the angle of the brush for more effective cleaning under objects of various heights.

Figure 8:
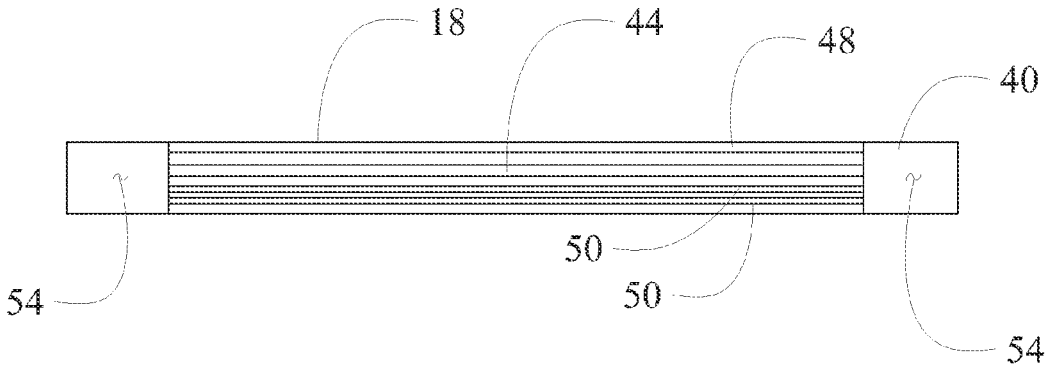
FIG. 8 is a front section view of the brush clip.

For the embodiment shown in FIG. 3, the spine 22 of the brush element 16 is substantially rigid to form curved side portions 52 in the brush element 16 to allow engagement of side boards or other similar surfaces with the brush element 16. Brush clip 18 as shown in FIG. 8 employs relieved portions 54 at each end of the brush clip in which the web 44, lips 48 and protrusions 50 are deleted from the front and rear walls to provide clearance for the curved portions of the spine 22.

Figure 9:
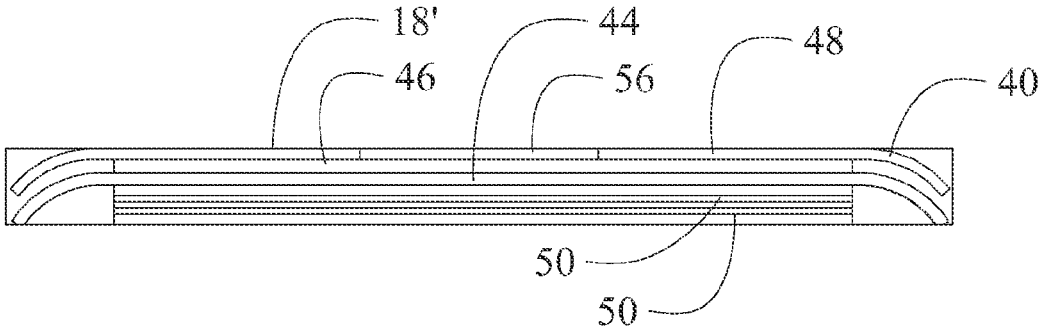
FIG. 9 is a front section view of an alternative form of the brush clip for a brush element having a flexible spine; and, FIG. 10 is a representation of the insertion of the flexible spine brush element into the brush clip of FIG. 9.
Figure 10:
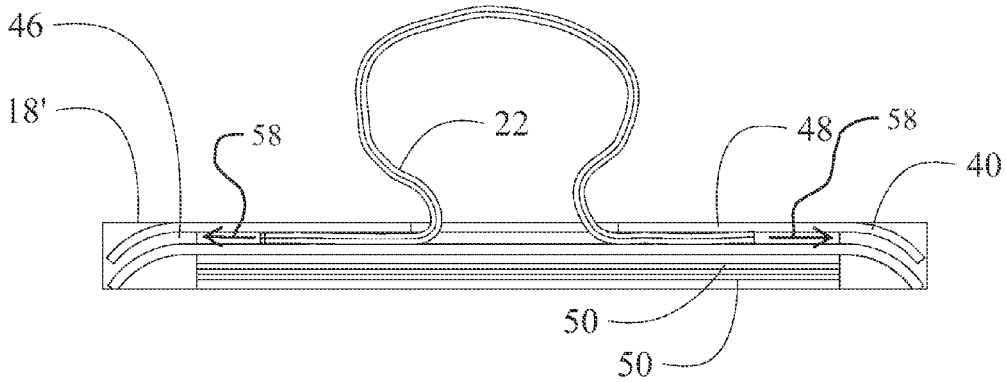

In an alternative embodiment, the brush element 16 may employ a flexible spine. As shown in FIG. 9, an alternative brush clip 18' may be employed in which the web 44 and lips 48 are curved at the lateral extents of the front wall 40 and rear wall 42 to curve the ends of channel 46 to urge the flexible spine into the desired curve to create the fan shape of the brush ends. Insertion of the brush element 16 into the alternative brush clip 18' is accomplished with a central gap 56 provided in the lips 48 allowing the brush spine 22 to be inserted into the upper channel 46 by arching the spine and inserting both ends into the channel at the central gap and sliding them along the channel in both directions as represented by arrows 58 in FIG. 10 to assume the channel shape (only the brush spine is shown without the bristles for clarity).

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. An upstanding brush assembly for attachment to a cleaning apparatus, said upstanding brush assembly comprising:

a brush element bending at lateral edges to a fan shape;

a brush clip receiving and constraining the brush element; and, a mounting bracket having a mounting flange attached to a top surface of a cleaning apparatus and having an upright flange extending from the mounting flange and removably engaged by the brush clip for positioning the brush element in a substantially vertical upstanding position extending beyond the top surface of the cleaning apparatus, the mounting bracket further having an angled flange extending from the mounting flange, said angled flange engaged by the brush clip for angled protrusion in an alternative angled cleaning position.

2. The upstanding brush assembly as defined in claim 1 wherein the brush element incorporates a spine and said brush clip includes an upper channel receiving the spine to constrain the brush element.

3. The upstanding brush assembly as defined in claim 2 wherein the brush clip incorporates a front wall and a rear wall joined with a web, said front wall, rear wall and web forming the upper channel.

4. The upstanding brush assembly as defined in claim 3 wherein the mounting bracket has an upright flange extending from a mounting flange and further wherein the front wall and rear wall and web additionally form a lower channel, said lower channel engaging the upright flange.

5. The upstanding brush assembly as defined in claim 4 wherein the brush clip is extruded aluminum.

6. The upstanding brush assembly as defined in claim 3 wherein the mounting bracket has an angled flange extending from a mounting flange and further wherein the front wall and rear wall and web additionally form a lower channel, said lower channel engaging the angled flange for angled protrusion in an alternative angled cleaning position.

7. The upstanding brush assembly as defined in claim 3 wherein the spine is substantially rigid and said front wall and rear wall have protruding lips distal from the web in the upper channel, at least one of said front wall, rear wall and lips resiliently flexible to receive the rigid spine.

8. The upstanding brush assembly as defined in claim 7 wherein the rigid spine is curved at the lateral ends of the brush element.

9. The upstanding brush assembly as defined in claim 8 wherein the brush clip includes relieved portions at the lateral ends, said web terminating at the relieved portion to accommodate the curved lateral ends of the rigid spine.

10. The upstanding brush assembly as defined in claim 3 wherein the brush element incorporates a flexible spine and the front wall and rear wall include lips protruding into the upper channel distal the web, said web and lips curved at the lateral ends of the brush clip to correspondingly curve the flexible spine of the brush element.

11. The upstanding brush assembly as defined in claim 10 wherein the lips incorporate a central gap through which opposite ends of the flexible spine may be inserted into the upper channel.

12. The upstanding brush assembly as defined in claim 3 wherein the brush clip is extruded plastic.

13. The upstanding brush assembly as defined in claim 3 wherein the brush clip is molded plastic.

* * * * *